United States Patent [19]

Gach

[11] 4,171,057

[45] Oct. 16, 1979

[54] CHILD-RESISTANT MEDICINE VIAL

[75] Inventor: Peter P. Gach, Evansville, Ind.

[73] Assignee: Sunbeam Plastics Corporation, Evansville, Ind.

[21] Appl. No.: 956,107

[22] Filed: Oct. 30, 1978

[51] Int. Cl.[2] ..... B65D 55/02; B65D 85/56; A61J 1/00

[52] U.S. Cl. ..... 215/211; 215/295

[58] Field of Search ..... 215/206, 209, 211, 216, 215/295; 220/306, 281

[56] References Cited

U.S. PATENT DOCUMENTS

| | | | |
|---|---|---|---|
| 3,372,834 | 3/1968 | Ayotte et al. | 220/306 |
| 3,430,798 | 3/1969 | Goyet et al. | 215/295 |
| 3,759,411 | 9/1973 | Horrath | 215/209 |
| 3,910,444 | 10/1975 | Foster | 215/295 |
| 4,098,418 | 7/1978 | Fields | 215/206 |

*Primary Examiner*—George T. Hall
*Attorney, Agent, or Firm*—Henry K. Leonard

[57] ABSTRACT

A child-resistant medicine vial, or the like consisting of a container and a cap therefor. The container has a hollow body and a tubular neck and the cap has a disc-like top and two concentric depending skirts. The inner skirt is adapted to be inserted into the open end of the container neck. The container has an outwardly extending annular flange which is spaced below the open end of the neck. The outer cap skirt is relatively flexible and extends telescopingly over the open end of the container, the bottom edge of the skirt reaching down into contact with or at least close to the flange. At least one upwardly extending ramp on the flange is engageable by a lug on the lower margin of the outer cap skirt. When the outer cap skirt is not stressed, the lug lies radially outside of the circular path defined by the ramp. The cap is removed by first squeezing the outer skirt inwardly at the lug location to move the lug into circumferential alignment with the ramp and then rotating the cap until the lug rides up the ramp, separating the margin of the outer cap skirt from the flange so the skirt can be engaged and the cap removed.

5 Claims, 5 Drawing Figures

CHILD-RESISTANT MEDICINE VIAL

BACKGROUND OF THE INVENTION

This invention relates to the general field of child-resistant containers for medicines, and the like, and particularly to the field of medicine vials in which pharmacists dispense tablets, pills, capsules, etc.

Possibly the most widely used type of child-resistant medicine vial consists of a tubular open topped container, usually molded from a transparent or semi-transparent resinous material, with circumferentially spaced, bayonet type threads on its exterior, these threads being located at a level a little distance below the open top of the container. The cap for this type of medicine vial has a disc-like top and a single skirt which fits circumjacent to the open end of the container and has a plurality of inwardly directed lugs which are engaged in the bayonet threads of the container by rotating the cap relative to the container. In order to secure the cap on the container against its being loose or lost, the cap usually has a flexible disc in its interior and the underside of the cap top has a central protrusion over which the perimeter of the disc is bent upwardly when the cap is thrust downwardly on the container and rotated so that the cap lugs snap into the bayonet threads on the container. The disc is flexible and is biased to thrust the cap upwardly, maintaining a tight engagement between the sets of cooperating threads and lugs.

While this type of medicine vial is widely used, it consists of three separate parts, viz: the container, the cap and the flexible disc. Thus, to manufacture these vials it is necessary to have two multi-compartment molds for the container and cap and a separate mechanism for punching out the flexible biasing discs. The discs must either be hand assembled in the caps or an additional piece of complex equipment is necessary to mechanically insert the discs into the caps.

Other types of child-resistant medicine vials have been suggested, for examples those shown in U.S. Pat. Nos. 3,372,834 to Ayotte, et al and 3,759,411 to Horvath. In both of these prior art patents, the cap and containers have cooperating lugs and ramps so that when the caps are rotated relative to the containers the edges of the caps are lifted or spaced away from the containers so that they can be grasped by the fingernail of the user and removed. However, this action results merely from rotation of the caps and containers relative to each other.

It has been found that the degree of child-resistance in a container and cap combination is greatly improved if removal requires two different movements. If the cap can be removed merely by rotation, a small child frequently will bite the cap between its teeth and turn the container relative to the cap. In both of the prior art patents mentioned above this would result in opening the container and giving the child access to its contents. This would defeat the very purpose of endeavoring to make the container child-resistant.

DESCRIPTION OF PREFERRED EMBODIMENT

Figure 1:
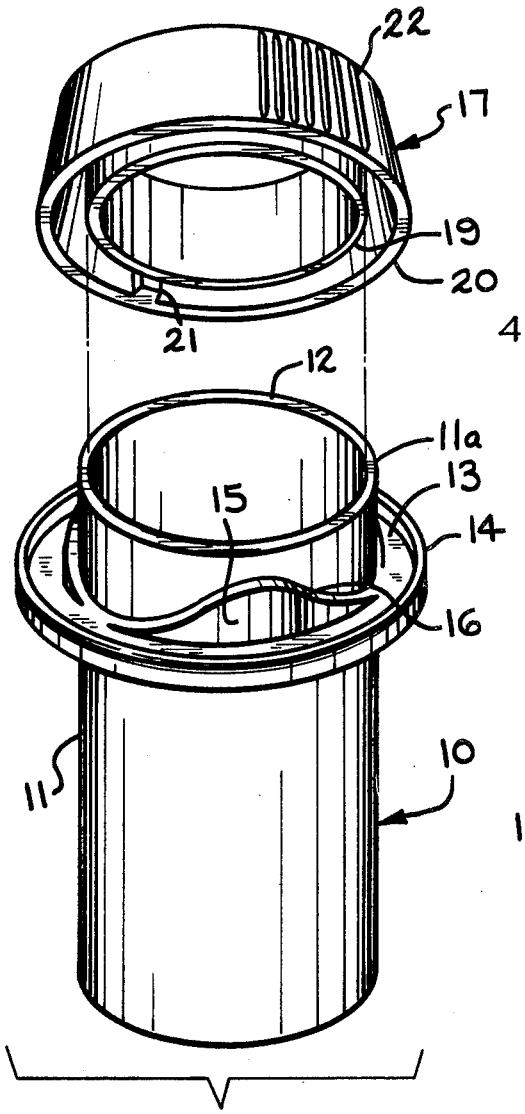
FIG. 1 is an exploded view in perspective showing a container and a cap therefor which embody the invention.
Figure 2:
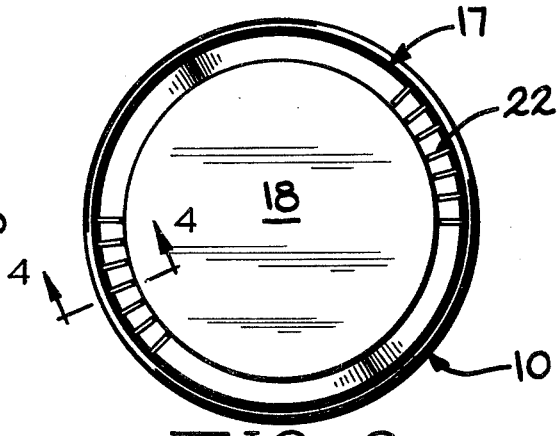
FIG. 2 is a plan view of the container and cap of the invention.
Figure 3:
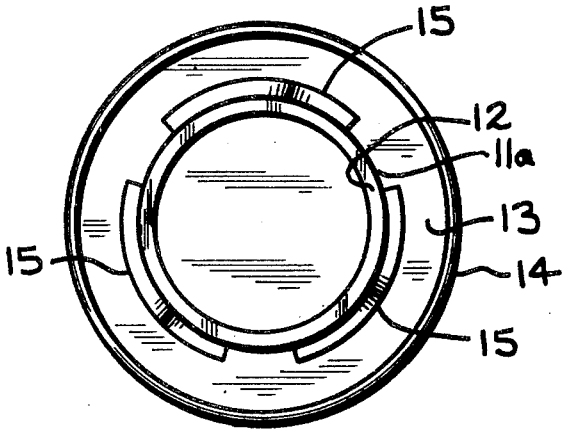
FIG. 3 is a plan view of the open top of the container of the invention.

A container 10, which is one of the two elements of the instant invention, has a hollow body 11 which has an open tubular neck 11*a* which has a flat annular lip 12. An outwardly extending annular flange 13 is located on the neck 11*a* and is spaced below the lip 12. In the preferred embodiment, the flange 13 has a rim 14 around its outer edge and the rim is concentric with and spaced outwardly from the outer surface of the neck 11*a*.

At least one ramp 15 is formed on the flange 13 circumjacent the outer surface of the neck 11*a*. In the embodiment of the invention shown in the drawing there are three of the ramps 15 and they are spaced evenly around the neck 11*a*. Each of the ramps 15 has an upwardly extending top surface 16 which rises from the flat surface of the flange 13 toward the lip 12. In the preferred construction each of the ramps 15 has two such upwardly extending surfaces 16 and thus each ramp 15 rises from the flange 13 in both directions. The radial thickness of each of the ramps 15 is less than the radial distance between the outer surface of the container neck 11*a* and the inner side of the flange rim 14.

Figure 4:
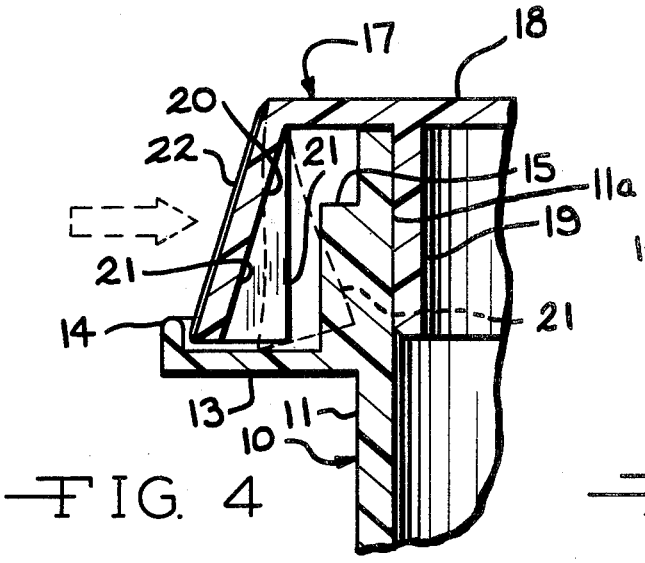
FIG. 4 is a greatly enlarged fragmentary view in vertical section taken along the line 4—4 of FIG. 2; and, FIG. 5 is a view similar to FIG. 4 but illustrating how a cap is separated from a container in order that the cap may be removed.

The invention also comprises a cap 17 which has a disc-like top 18 and a pair of concentric, downwardly extending skirts 19 and 20. The inner skirt 19 is of such size as to be adapted to fit into the open end of the container neck 11*a* as can best be seen in FIG. 4. The outer skirt 20 preferably is frusto-conical in shape and is of such size as to telescopingly fit over the end of the container neck 11*a* and to reach down a distance such that when the cap 17 is in place on the container 10 the lower margin of the outer skirt 20 reaches at least very close to the upper surface of the container flange 13 (FIG. 4). When the cap 17 is in place, the rim 14 prevents anyone from inserting his fingernail or a flat instrument, such as a nail file, beneath the margin of the outer skirt 20 to pry the edge of the cap 17 upwardly.

At least one cap lug 21 is molded on the inner side of the outer cap skirt 20 and, as best can be seen in FIG. 4, its radial thickness is less than the distance between the inner surface of the outer skirt 20 and the outer surface of the ramps 15.

When the cap 17 is in closed position on the container 10, as shown in FIG. 4, the cap lug 21 is spaced radially outwardly from the ramps 15 so that mere rotation of the cap 17 relative to the container 10 does not bring the cap lug 21 into engagement with any of the ramps 15.

Figure 5:
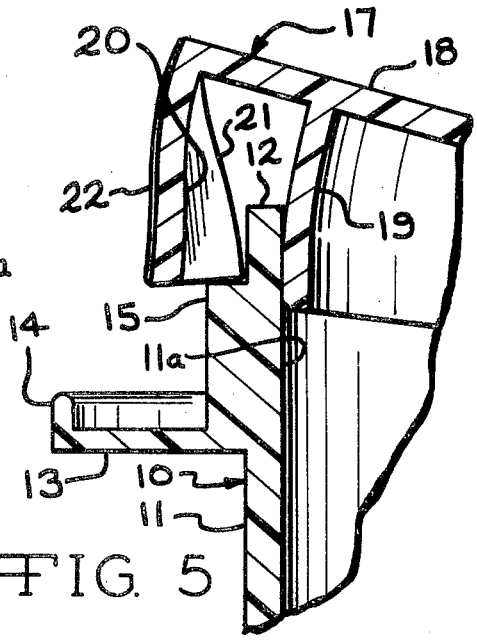

In order to remove the cap 17 from the container 10 and thus gain access to the material container therein, it is necessary first to squeeze inwardly on the outer skirt 20 as indicated by the arrow in FIG. 4, flexing the skirt and thrusting the cap lug 21 radially inwardly into circumferential alignment with the ramps 15 as indicated in broken lines in FIG. 4. While holding the outer skirt 20 in this compressed position, the cap 17 is then rotated in either direction so that the lug 21 engages one of the ramps 15 and rides up its top surface lifting the cap 17 as illustrated in FIG. 5. It is then relatively easy for the user to grasp the lower margin of the outer skirt 20 and peel the cap 17 away.

When it is desired to re-cover the container 10, the cap 17 is merely centered over the container 10 and thrust downwardly with the inner skirt 19 entering the open end of the neck 11*a* and the outer skirt 20 again being released to reassume its relaxed position as illustrated in FIG. 4.

As illustrated in the drawings, and if desired, the upper portion of the outer skirt 20 may be molded with a few ribs 22 both to indicate the location of the interior lug 21 and to facilitate turning the cap 17 after it has been squeezed inwardly.

Having described my invention, I claim:

1. A combination child-resistant container and cap therefor, consisting of:

(a) a container having, (1) an open topped body which has an open annular neck terminating in an annular lip that lies in a radial plane of the neck, (2) a thin planar, annular flange extending outwardly from the outer side of said body the upper surface thereof being spaced axially below said lip, and (3) at least one arcuate ramp on said flange, said ramp having a radial thickness less than the width of said flange and said ramp having an upwardly extending top surface rising at at least one end from the upper surface of said flange, and, (b) a cap for said container, said cap having (1) a disc-like top, (2) a resilient inner, tubular skirt depending from said top and adapted to tightly fit into the interior of said container neck, (3) an outer, annular skirt depending from said top which is adapted to telescope over said container neck and which has, (a) an axial length such as to extend downwardly into close proximity to said container flange, (b) an outer diameter at its bottom edge no greater than the outer diameter of said flange, (c) an inner diameter greater than the outer diameter of said ramp, and, (4) at least one lug on the inner side of said outer skirt, said lug having a radial thickness less than the space between the outer side of said ramp and the inner side of said outer skirt,

2. A combination container and cap according to claim 1 in which the outer skirt of the cap is frusto-corrical,

3. A combination container and cap as defined in claim 1 in which the upper surface of the ramp has an upwardly inclined portion at both ends,

4. A combination according to claim 1 which there are a plurality of ramps spaced from each other around the container flange.

5. A combination according to claim 1 and an upwardly extending annular rim on the perimeter of the flange, the outer diameter of the bottom edge of the outer skirt being less than the inside diameter of said flange.

* * * * *